United States Patent [19]

Magin

[11] Patent Number: 4,928,338

[45] Date of Patent: May 29, 1990

[54] PROCESS FOR THE WET TREATMENT OF TEXTILE MATERIAL

[75] Inventor: Berthold Magin, Hassloch, Fed. Rep. of Germany

[73] Assignee: MTM Obermaier GmbH & Co. KG

[21] Appl. No.: 303,963

[22] Filed: Jan. 27, 1989

Related U.S. Application Data

[63] Continuation-in-part of Ser. No. 25,513, Mar. 13, 1987, abandoned.

[30] Foreign Application Priority Data

Mar. 15, 1986 [DE] Fed. Rep. of Germany ..... 3608742

[51] Int. Cl.[5] ..... D06B 3/10

[52] U.S. Cl. ..... 8/149.1; 8/152; 8/155.1; 8/158

[58] Field of Search ..... 8/149.1, 154, 155.1, 8/158, 152; 68/189, 177, 178

[56] References Cited

U.S. PATENT DOCUMENTS

| | | | |
|---|---|---|---|
| 3,145,555 | 8/1964 | Krantz | 68/189 |
| 3,418,065 | 12/1968 | Blount, Jr. | 8/158 |
| 3,600,731 | 8/1971 | Bergholtz | 8/149.1 |
| 3,775,055 | 11/1973 | Wedler | 8/155.1 |
| 3,871,821 | 3/1975 | Winn et al. | 8/155.1 |
| 3,967,923 | 7/1976 | Ameling | 8/149.1 |
| 3,974,534 | 8/1976 | Yelton et al. | 8/155.1 |
| 4,369,035 | 1/1983 | Karrer et al. | 8/149.1 |
| 4,427,409 | 1/1984 | Gregorian et al. | 8/149.1 |
| 4,499,620 | 2/1985 | Minagawa | 8/158 |

OTHER PUBLICATIONS

Woskresenskij, P., Moscow, 1962, pp. 355–357.

*Primary Examiner*—Frankie L. Stinson
*Attorney, Agent, or Firm*—Toren, McGeady & Associates

[57] ABSTRACT

A process for the wet treatment of textile materials having capillary-active properties. The textile material, for example, in the form of yarn bobbins, is placed into a treatment vessel with a heated liquid containing chemicals. A negative pressure is generated in the treatment vessel until the liquid boils viborously. The negative pressure is created by means of a vacuum pump connected to the treatment vessel through an intermediate vessel, a liquid separator, pipelines and valves. Simultaneously, a gas, for example, nitrogen, air or oxygen is conducted through a valve into the liquid, so that the entire liquid volume is transformed into a froth having fine pores. The vacuum treatment step is followed by an intermediate treatment step during which the gas valve is closed and the liquid is circulated by means of a circulating pump. The liquid is thus reheated and the vacuum reestablished.

16 Claims, 2 Drawing Sheets

PROCESS FOR THE WET TREATMENT OF TEXTILE MATERIAL

This is a continuation-in-part of application Ser. No. 07/025,513, filed Mar. 13, 1987 now abandoned.

BACKGROUND OF THE INVENTION

1. Field of the Invention

The present invention relates generally to a process for the wet treatment of textile materials. More particularly, the invention relates to a process for cleaning, bleaching, scouring, dyeing, fixing and the like of textile materials having capillary-active properties by means of chemicals dissolved in a liquid. The textile material to be treated is present in the form of loose fibers, yarn or piece goods. The liquid filled into a vessel is intermittently or alternately moved and thereby caused to act on the textile material by means of essentially only a partial evaporation which is regulated by a controlled pressure reduction in the vessel. A pulsating motion is imparted to the liquid while it acts on the textile material by the introduction of a gaseous medium.

2. Description of the Prior Art

In bleaching textile material, the material is discolored, particularly by means of oxidation or reduction. The chemicals and the process technology utilized must carefully be adjusted to the materials to be treated. Since many chemicals quickly decompose when they are, for example, heated, stabilizers are required for slowing down the disintegration. However, these stabilizers make bleaching expensive and complicated.

A process in which an undyed or uncolored material is colored or in which a colored material is given a different color is generally called dyeing. The dye is transferred to the material by adsorption at the surface, by diffusion, by formation on or in the fiber, or by chemical reaction. The treatment is predominantly effected in aqueous solutions or in suspensions of dyes with the addition of dyeing auxiliaries, such as, wetting agents, salts, alkalies, acids etc. The dyeing process is carried out by either moving the material through the motionless liquor or by causing the liquor to flow through the material.

Specific dyeing processes are the jet process, the high temperature process, the pad-roll process, the pad-steam process, the stand-fast process and the thermosol process.

Also known is the foam dyeing process. However, this process is utilized less frequently. In this process, bubbles are generated in the liquor by the addition of foaming agents. These bubbles are utilized for transferring to the material to be dyed specific dyes whose molecules have hydrophilic as well as hydrophobic ends.

In addition, dyeing processes are known which utilize solvents other than water. Usually volatile hydrocarbons are used. However, these processes are not used in practice because of the harmful, frequently even toxic or explosive, properties of the solvents.

It is the object of all dyeing processes to obtain a bond between the dyes and the material to be dyed utilizing means which are as inexpensive and uncomplicated as possible. The durability and stability of this bond is an essential measure of the degree of fastness of the dyeing. The procedures which are carried out for dyeing are partially of a chemical and partially of a physical nature. Particularly in capillary-active fibers, physical processes on the basis of capillary and osmotic forces clearly predominate. The best known representatives of capillary-active fibers are wool and cotton, however, synthetic fibers may also be included. The capillary and osmotic forces act equally during cold dyeing or hot dyeing, during discoloring as well as during bleaching.

Most of the bleaching and dyeing processes require a large amount of time and energy. The liquor and/or the material must be uniformly moved. Especially the temperature must be adjusted to the correct value. Frequently a temperature increase during the process of up to more than 100° C. is required.

No. DE-A-27 14 802 discloses a dyeing process for textile materials consisting of natural fibers or synthetic fibers or mixtures thereof. In this process, dyeing is carried out under negative pressure. The temperature of the liquid is maintained at the boiling point for about 10 minutes with the prevailing negative pressure being taken into consideration. Subsequently, pressure and temperature are quickly increased and dyeing of the textile material is concluded by means of the conventional process. In this known process, a more intensive dyeing is expected to result, while the treatment time is shorter and the energy required is reduced. This result is essentially due to the fact that the vacuum sucks off a large part of the air which usually prevents moistening of the textile material with liquid. The treatment of the material is careful because of the reduced temperature and the reduced duration of the process. In addition, a better utilization of the dyes was observed. By reducing the portion of air contained in the treatment vessel, it is also possible to process with fewer problems dyes which are sensitive to certain gaseous components in the air.

No. EP-B-22 572 discloses another process for the treatment of textile materials under vacuum. In this process, the liquid is moved and thereby caused to act on the textile material essentially exclusively by local partial evaporation due to a controlled pressure reduction in the treatment vessel. The entire dyeing process takes place under vacuum. Dyeing under normal pressure with simultaneous pumping of the liquid is not intended. Since the liquid cools off during the continuous partial evaporation, the liquid is continuously reheated. This reheating is preferably effected by a direct introduction of vapor. Due to the negative pressure in the treatment vessel, an explosive expansion of the vapor bubbles introduced into the liquid takes place. As a result, a pulsating motion is additionally imparted to the liquid. On the other hand, these explosions are so strong that sensitive materials, for example, yarns wound onto bobbins, may be destroyed. The vapor which is introduced increases the temperature of the liquid, so that the evaporation increases and the vacuum collapses unless a very powerful and, thus, expensive vacuum pump is used.

Another disadvantage of the known process resides in the fact that commercially used vapor usually is contaminated, particularly with iron. Many dyes, particularly the indanthrene dyes, are negatively influenced or even destroyed by vapor. Therefore, the known process can only really be used for a relatively small number of dyes.

Finally, it should be pointed out that the vapor supplied at least partially condensates to water, so that the treatment liquid becomes thinner. Consequently, the treatment times are increased and the treatment results become poorer. Furthermore, a formation of foam, as it is desired in some cases, does not occur.

It is, therefore, the primary object of the present invention to provide a process of the afore-mentioned type which is quick, energy-saving and inexpensive. In addition, the textile material is to be subjected to a careful treatment. Also, a particularly simple and effective control of the process conditions is desired.

SUMMARY OF THE INVENTION

In accordance with the present invention, the process of the present invention for the wet treatment of material by means of chemicals dissolved in a liquid contained in a vessel includes the steps of heating the liquid to a predetermined temperature and moving the liquid through the materials by means of a pumping unit at least during a part of the duration of the treatment. The method comprises initially heating the liquid to a temperature of between 50° and 80° C., and subsequently reducing the pressure in the vessel until a preselected negative pressure value is reached, wherein the preselected negative pressure value corresponds to a saturation vapor temperature which is between 5° and 30° lower than the predetermined temperature of the liquid. Finally, a plurality of bubbles forming fine pores are generated throughout the entire liquid, so that an intensive additional movement is imparted to the liquid.

In accordance with a preferred embodiment of the invention, the bubbles are generated by introducing small quantities of a gas, wherein the gases of the type which does not condense under operating conditions defined by the predetermined temperature, the preselected negative pressure value and the liquid, and which does not dilute the liquid. The gas may be air, nitrogen, oxygen or chlorine.

In accordance with a further preferred embodiment of the invention, the bubbles are generated by cavitation at a liquid pump.

In addition to the known advantages of the vacuum treatment, i.e., reduction of required energy due to lower temperatures of the liquid, quick and complete reaction of the chemicals and careful treatment of the materials, the invention provides the additional advantages that the liquid is additionally moved in a particularly careful manner because the supply of gas which is not a vapor transforms the entire liquid volume into a foam having extremely fine pores. Since, contrary to vapor, the gas does not condensate, the concentration of the chemicals in the liquid is not reduced. On the contrary, the concentration of the chemical is continuously increased due to the continuous evaporation of the liquid caused by the reduced pressure. On the other hand, not too much liquid is evaporated because of the continuous cooling, so that it is possible to carry out the process with relatively small vacuum pumps.

The vacuum treatment step is followed by the intermediate treatment step during which the liquid is again heated and the vacuum is reestablished as necessary. Thus, the process according to the invention essentially includes two treatment steps which are alternatingly repeated until the desired result is obtained.

During the intermediate treatment step, the liquid is preferably circulated by pumping it in the known manner via a heat exchanger.

Accordingly, the treatment process is not completely interrupted.

It is basically also possible to circulate the liquid by pumping during the vacuum treatment step. However, many pumps are subject to cavitation due to the presence of the vacuum.

In accordance with a preferred embodiment of the invention, the connection to the vacuum pump is blocked at the beginning of the vacuum treatment step. The vacuum is continuously reduced by the supply of gas and the evaporation of the liquid, so that the vacuum treatment step is stopped automatically. This has the advantage that the vacuum pump does not have to be used continuously. However, the principal advantage of this feature of the invention is to be seen in the fact that the gas which is supplied accumulates above the liquid and does not reach the vacuum pump. Rather, the gas forms a gas cushion.

In accordance with a preferred further development of the invention, the gas supply is stopped at the end of the vacuum treatment step and the gas is sucked off above the liquid before the intermediate treatment step begins. The gases can then again be returned into the process or can be removed harmlessly.

In accordance with a further preferred development of the invention, the temperature of the liquid is always below 100° C. In the treatment of cotton, the temperature is preferably between about 60° and 70° C. Cotton can be particularly quickly dyed in this specific temperature range of from 60° to 70° C. In addition, the low temperatures ensure that the material is treated carefully. In addition, the liquid must only be heated slightly, so that energy is saved. Also, the negative pressure required for the process according to the invention is at a level which can be obtained by means of relatively inexpensive vacuum pumps.

In accordance with another embodiment of the invention, the reducing gas may be, for example, chlorine, the oxidizing gas may be, for example, oxygen or air, and the neutral gas may be, for example, nitrogen. Thus, when dyeing is performed with oxidative dyes, the required neutral atmosphere can initially be obtained by means of nitrogen, and the required oxidizing atmosphere can subsequently be obtained by the use of air or also by the use of oxygen.

In accordance with yet another further development of the invention, the negative pressure can be generated suddenly, for example, by quickly opening a connecting line having a large cross-sectional area between the treatment vessel and an evacuated intermediate vessel. This results in an intensive movement of the liquid and of the material placed in the liquid.

Moreover, it is possible to remove the material continuously from the liquid and subsequently to place it again in the liquid. When the material is removed from the liquid, the liquid still adhering to the material is evaporated due to the prevailing negative pressure. However, the material simultaneously remains in the gas cushion formed above the liquid which may have neutral or reactive properties depending on the gas used.

A foaming agent may be added as necessary in order to further increase the formation of foam which is already intensive in the process according to the present invention.

In order to obtain a particularly effective removal of gas from the material to be treated, negative pressure may be created in the treatment vessel already before the liquid comes into contact with the material. The effects which can be obtained by this step are basically known. This step is mentioned here in order to emphasize that the process according to the invention provides excellent results even without this prior evacuation.

If it is necessary that certain materials, such as, polyester, are to be fixed at increased temperatures, the pressure and the temperature in the vessel can be increased, for example, to conventional values of about 130° C. and pressures of slightly below 3 bar.

Finally, in the process according to the present invention, the liquid can also be indirectly heated during the vacuum treatment step, for example by means of a heat exchanger.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
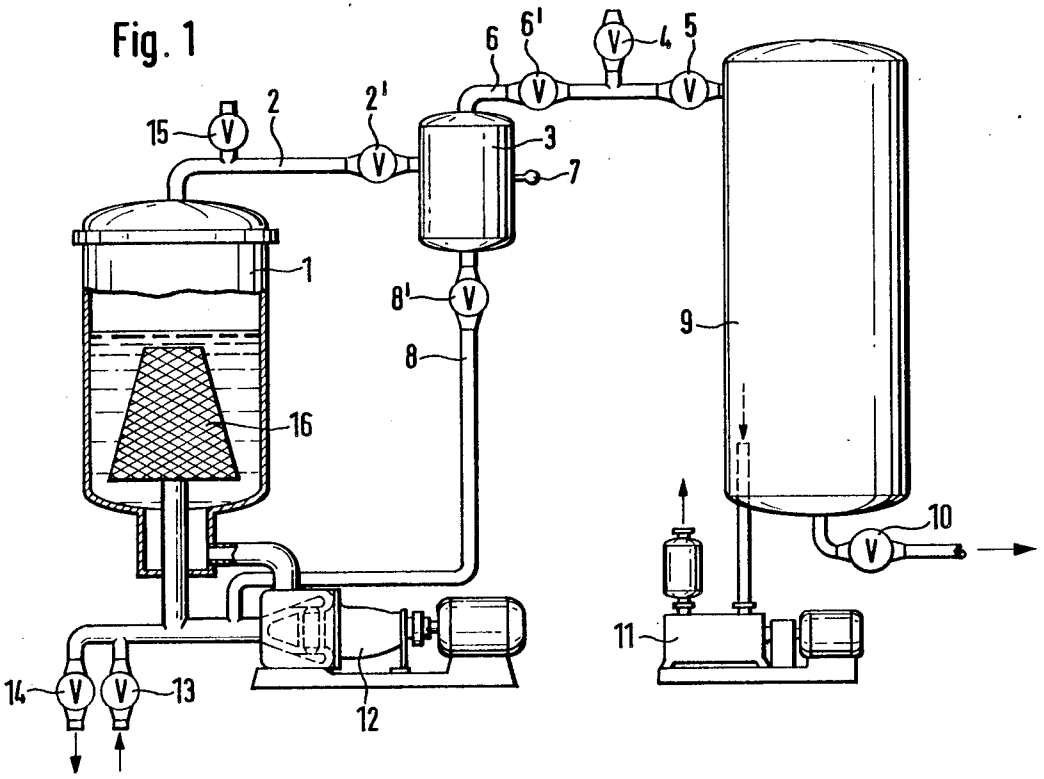
FIG. 1 is a schematic view of an arrangement used to carry out a method of dyeing yarns wound onto bobbins according to the present invention.

FIG. 1 shows a closed, vacuum-tight treatment vessel 1 used particularly for dyeing yarns wound onto bobbins. The yarn is symbolically illustrated with a single yarn bobbin 16. The treatment vessel 1 is partially filled with liquid in which the dyeing chemicals are dissolved.

The treatment vessel 1 has a cover from which a pipeline 2 leads to a liquid separator 3. A valve 15 effects a connection between the treatment vessel 1 and the surrounding atmosphere. A valve 2 effects a connection between pipeline 2 and liquid separator 3.

A line 8 which includes a valve 8' leads from the bottom of the liquid separator 3 to a circulating pump 12 or into the treatment vessel 1. Line 8 serves to conduct liquid which collects in the liquid separator 3 into the treatment vessel 1.

A pipeline 6 leads from liquid separator 3 to an intermediate vessel 9 to which is connected a vacuum pump 11. An outlet valve 10 is used for discharging liquid which is collected in intermediate vessel 9.

An outlet valve 14 is used for emptying the treatment vessel 1.

Gas is supplied through a valve 13.

In the arrangement described above, the yarns 16 are treated as follows. After the yarns 16 have been placed in the treatment vessel 1 and the treatment vessel 1 has been closed, liquid is conducted into the treatment vessel 1 until the yarns 16 are covered. The valves 4, 8', 10, 13, 14 and 15 are closed. The intermediate vessel 9, the liquid separator 3 and the treatment vessel 1 are evacuated by means of vacuum pump 11. During this evacuation, one of the valves 2', 6' or 5 may also be closed. The liquid in the treatment vessel 1 has a temperature of, for example, 70° C. The pressure in the intermediate vessel 9 is reduced to, for example, 0.1 bar absolute. This corresponds to a water boiling temperature of about 45° C.

As soon as this negative pressure reaches the temperature vessel 1 by opening one of the previously closed valves 2', 6' or 5, the liquid begins to boil vigorously. Simultaneously, valve 13 is opened and gas in introduced which travels through the yarn bobbin 16 in the form of bubbles preferably from the inside to the outside. As soon as the gas, such as, air, comes into contact with the liquid, the entire volume of liquid is transformed into a foam having fine pores which influences the chemicals dissolved in the liquid in such a way that they preferentially deposit on the fibers of the yarns 16. Thus, the dyes attach themselves to the fibers very quickly.

Since a portion of the water evaporates during the boiling of the liquid, the concentration of the chemicals is increased. This increased concentration is desired.

The gas which has been supplied is sucked off by means of vacuum pump 11. The liquid vapor which has been sucked off is separated in the liquid separator 3 and actuates level switch 7. After opening valve 8', this liquid can then be returned into the treatment vessel 1 through line 8.

Due to the evaporation of the liquid and the supply of the gas, the temperature of the liquid drops. Thus, the evaporation process is stopped if the liquid is not heated by means of a heat exchanger to be mounted in the treatment vessel.

At the latest at this time, the connection to the vacuum pump 11 is closed, for example, by closing valve 2'. The gas valve 13 is closed and the circulating pump 12 is switched on. Since the pressure in the treatment vessel 1 and the temperature of the liquid are now at an equilibrium, no danger exists that cavitation may occur in the circulating pump 12.

During this intermediate treatment step, the temperature of the liquid is again increased and the liquid is simultaneously forced through the yarn bobbins 16, as is the case in conventional dyeing processes. Should the pressure in the intermediate vessel 9 have risen due to the small capacity of the vacuum pump 11, the vacuum is then again reestablished.

The vacuum treatment step and the intermediate treatment step are repeated alternatingly until the desired treatment result has been obtained.

It should be emphasized once again that the gases introduced through valve 13 are gases which do react with the liquid or chemicals dissolved in the liquid, but which do not dilute the concentration of chemicals, as would be the case if vapor were used. Finally, it should also be emphasized that the introduction of the gas into the liquid results in a foam having fine pores. Such a foam is not formed if vapor is introduced. Vapor bubbles which are introduced explosively collapse due to the negative pressure in the treatment vessel 1, so that the danger exists that the materials to be treated are damaged.

Figure 2:
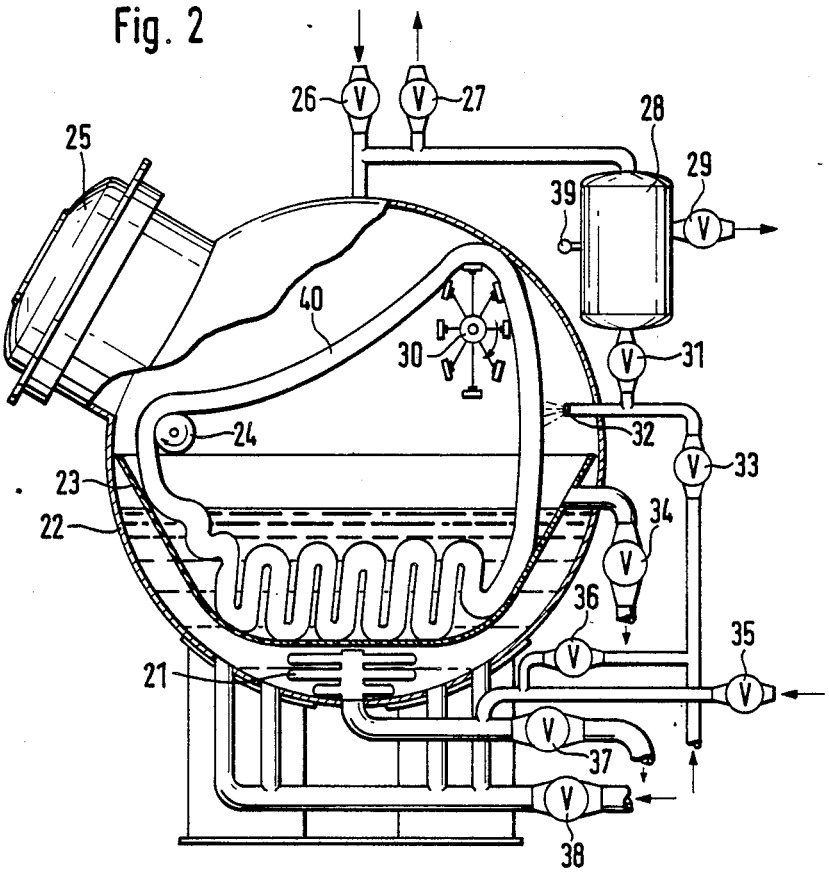
FIG. 2 is a schematic view of an arrangement used to carry out a method of dyeing textile fabrics according to the present invention.

FIG. 2 shows an arrangement used for the treatment of longer textile fabrics in rope form. A treatment vessel 22 partially filled with liquid includes a basket 23 which receives a portion of the fabrics 40. Fabrics 40 are continuously transported in a circle by means of a driven guide roller 24 and a reel 30 having an elliptical cross-section. As a result, the fabrics 40 are partially below and partially above the liquid. The opening for introducing and removing the fabrics 40 is closable in a vacuum-tight manner by a cover 25.

A vacuum pump, not shown, is connected to a vacuum valve 29 of a liquid separator 28, so that a negative pressure can be generated in treatment vessel 22. An intermediate vacuum vessel is not absolutely required in this case because the free space within treatment vessel 22 is very large. The remaining valves are connected. The liquid is again heated to a temperature of, for example, 70° C. The pressure in vessel 22 is again reduced to such an extent that the liquid boils vigorously.

By opening valve 38, gas is introduced into the liquid at several locations and a foam having fine pores is formed.

After opening valve 38, valve 29 leading to the vacuum pump can be closed. The gas which has been introduced is collected above the liquid in the treatment vessel 22. Consequently, the vacuum treatment step is automatically stopped when the negative pressure has risen to such an extent that the boiling temperature of the liquid has been reached. This gas can now be sucked off through one of valves 26, 27 and the gas can either be used again or can be harmlessly removed. The gas cannot reach the vacuum pump.

The portion of the fabrics 40 which is located outside of the liquid at a given time is slightly dried due to the prevailing negative pressure. As a result, the chemicals are deposited in the fabric particularly quickly. Nevertheless, this portion of the fabrics is located in a gas cushion. If the gas is a reactive gas, such as oxygen or air, the chemical reactions continue to take place. If the gas is a neutral gas, such as nitrogen, undesired chemical reactions are prevented.

The vacuum treatment step is then again followed by an intermediate treatment step during which the liquid is circulated by means of a circulating pump, not shown, through an opened valve 37 and an opened valve 33. Simultaneously, the liquid is heated, either by means of a heating coil 21 mounted in the treatment vessel 22 or by means of an external heat exchanger. For the reasons already desribed above, heating of the liquid by means of vapor directly introduced into the liquor is to be avoided.

Any liquid which is collected in the liquid separator 28 is returned through a valve 31 into the treatment vessel 22 as soon as level switch 39 is actuated.

Additional liquid, such as, liquid containing fresh chemicals, may be introduced into the treatment vessel 22 through a valve 36.

A valve 34 serves as a overflow valve.

While specific embodiments of the invention have been shown and described in detail to illustrate the application of the inventive principles, it will be understood that the invention may be embodied otherwise without departing from such principles.

I claim:

1. In a process for the wet treatment of materials by means of chemicals dissolved in a liquid contained in a vessel, including the steps of heating the liquid to a predetermined temperature and moving the liquid through the materials by means of a pumping unit at least during a part of the duration of the treatment, the improvement comprising initially heating the liquid to a temperature of between 50° and 80° C., subsequently reducing the pressure in the vessel until a preselected negative pressure value is reached, wherein the preselected negative pressure corresponds to a saturation vapor temperature which is between 5° and 30° C. lower than the predetermined temperature of the liquid, and generating a plurality of bubbles forming fine pores within the entire liquid, whereby an intensive additional movement is imparted to the liquid, wherein the bubbles are generated by introducing small quantities of a gas into the vessel, the gas being of the type which does not condense under operating conditions defined by the predetermined temperature, the preselected negative pressure value and the liquid, and which does not dilute the liquid.

2. The process according to claim 1, wherein the treatment includes washing, scouring, bleaching or dyeing.

3. The process according to claim 1, wherein the materials are loose fiber, yarn or piece goods.

4. The process according to claim 1, wherein the materials are wool, silk, feathers, down, skins, leather, cotton or other cellulose material.

5. The process according to claim 1, wherein the materials are synthetic fibers.

6. The process according to claim 5, wherein the materials are of polyamide, polyester, polyacrylonitrile, polypropylene, polyurethane.

7. The process according to claim 1, wherein the materials are rubber or cork.

8. The process according to claim 1, wherein the liquid is indirectly heated when the pressure in the vessel is reduced.

9. The process according to claim 1, wherein the step of reducing the pressure is repeated a plurality of times and the liquid is reheated to the predetermined temperature in the intervals between the steps of reducing the pressure.

10. The process according to claim 1, wherein the gas is air.

11. The process according to claim 1, wherein the gas is nitrogen.

12. The process according to claim 1, wherein the gas is oxygen.

13. The process according to claim 1, wherein the gas is chlorine.

14. The process according to claim 1, comprising the further step of repeatedly removing the materials from the liquid and re-immersing the materials into the liquid.

15. The process according to claim 1, wherein the negative pressure is generated suddenly.

16. In a process for the wet treatment of materials by means of chemicals dissolved in a liquid contained in a vessel, including the steps of heating the liquid to a predetermined temperature and moving the liquid through the materials by means of a pumping unit at least during a part of the duration of the treatment, the improvement comprising initially heating the liquid to a temperature of between 50° and 80° C., subsequently reducing the pressure in the vessel until a preselected negative pressure value is reached, wherein the preselected negative pressure corresponds to a saturation vapor temperature which is between 5° and 30° C. lower than the predetermined temperature of the liquid, and generating a plurality of bubbles forming fine pores within the entire liquid, whereby an intensive additional movement is imparted to the liquid, wherein the bubbles are generated by introducing small quantities of a gas into the vessel, the gas being of the type which does not condense under operating conditions defined by the predetermined temperature, the preselected negative pressure value and the liquid, wherein the bubbles are generated by cavitation at a liquid pump.

* * * * *